United States Patent [19]

Gonzalez

[11] 4,125,657

[45] Nov. 14, 1978

[54] DECORATIVE ARTICLE AND METHOD

[76] Inventor: Jose B. Gonzalez, Estado Apure, El Amparo, Venezuela

[21] Appl. No.: 845,825

[22] Filed: Oct. 26, 1977

[51] Int. Cl.[2] ..... D06P 3/00

[52] U.S. Cl. ..... 428/90; 8/1 XB; 427/203; 427/206; 428/446

[58] Field of Search ..... 8/1 XB, 4; 427/203, 427/206; 428/446; 482/90

[56] References Cited

U.S. PATENT DOCUMENTS

| | | | |
|---|---|---|---|
| 333,457 | 12/1885 | Foster | 427/283 X |
| 2,016,314 | 10/1935 | Bucy | 427/283 X |
| 2,452,024 | 10/1948 | Wilson | 23/305 A X |
| 3,968,274 | 7/1976 | Harris et al. | 427/203 |

*Primary Examiner*—A. Lionel Clingman
*Attorney, Agent, or Firm*—Charles L. Gholz

[57] ABSTRACT

Amazingly beautiful decorative objects can be made by a method comprising the steps of (1) producing a chemically pure, over-saturated solution of potassium aluminosilicate, (2) coating substrates to be decorated with flock, (3) introducing the substrates into the solution, (4) removing the substrates from the solution after crystals have grown on the substrates, (5) drying the crystals, (6) coating the crystals with a transparent brilliant liquid plastic, and, optionally, (7) dyeing the plastic, either before or after it has dried. Alternatively, dye may be introduced directly into the solution.

8 Claims, No Drawings

DECORATIVE ARTICLE AND METHOD

FIELD OF THE INVENTION

This invention pertains to decorative objects, such as tiles, religious statuary, trivets, etc., and to a method of making the same.

SUMMARY OF THE INVENTION

It has been found that amazingly beautiful decorative objects can be made by a method comprising the steps of (1) producing a chemically pure, over-saturated solution of potassium aluminosilicate, (2) coating substrates to be decorated with flock, (3) introducing the substrates into the solution, (4) removing the substrates from the solution after crystals have grown on the substrates, (5) drying the crystals, (6) coating the crystals with a transparent brilliant liquid plastic, and, optionally, (7) dyeing the plastic, either before or after it has dried. Alternatively, dye may be introduced directly into the solution.

DETAILED DESCRIPTION OF THE PREFERRED EMBODIMENT

In order to manufacture decorative articles in the manner of the present invention, a suitable substrate is obtained. Such a substrate may be a suitably shaped piece of ceramic or metal, the surface of which is preferably smooth. The substrate is then coated with flock. A suitable method for coating the substrate with flock is as follows: the substrate is first coated with a white enamel paint, then, while the paint is still wet, the substrate is placed in a large plastic pouch containing flock and moved through the flock until the surface of the paint is thoroughly coated with the flock, after which no more flock will adhere to the substrate. The substrate is preferably left in the plastic pouch for a short period (e.g., 5 minutes) to allow the paint to dry, firmly adhering the flock to the substrate. As for the flock itself, neither its particle size nor its composition is critical to my invention. As is well known, flock is powder conventionally made from finely minced cotton fibers, but it can also be made from wool, rayon, or other fibers, and various types of suitable flock are readily commercially available.

A chemically pure, over-saturated solution of potassium aluminosilicate is then produced. A suitable method for producing the solution is as follows: A mixture of 70 parts of water and thirty parts of potassium aluminosilicate are placed in an inoxidizable tank and heated to 100° Celsius. The mixture is stirred, and, after about 15 minutes, it is taken off the heat and filtered through a woven material to remove undissolved potassium aluminosilicate. The mixture is then allowed to sit quietly, cooling, until it has reached the temperature of approximately 37° Celsius. At that point, the previously prepared flock-coated substrates are introduced into the solution, taking care that they (or at least the principal surfaces thereof) do not touch the walls of the tank or each other.

The flock-coated substrates are left in the solution for approximately 3 to 5 hours, the exact time being a function of the desired size of the crystals, whether the solution is maintained at 37° Celsius or allowed to cool to room temperature, and whether or not the solution is replenished as some material precipitates out. After crystals have grown on the substrates to the desired size, the substrates are carefully removed from the tank, and the crystals are dried or allowed to dry. This may be accomplished by suspending the substrates from a point or points other than their principal surfaces and applying a gentle stream of dry air to the crystals.

After 4 or 5 hours, the crystals are coated with a transparent, brilliant liquid plastic, such as a methacrylate resin. Preferably the resin is, specifically, polymerized methyl methacrylate resin. A liquid plastic sold under the trademark REITHANE by the Reinco Liquid Plastics Company of Caracas, Venezuela, has been found particularly suitable for this purpose, but the liquid plastic methyl methacrylate resin sold under the trademark LUCITE by E. I. duPont de Nemours & Co. is also suitable, as well as many other commercially available transparent, brilliant liquid plastics. The coating is then allowed to dry, which takes approximately 5 hours. Preferably second and third coatings of the liquid plastic are then added.

The REITHANE brand liquid plastic and most other such transparent, brilliant liquid plastics accept standard aniline dyes, which may be added to the liquid plastic prior to its being coated on the crystals or coated on the plastic after it has dried. Alternatively, dye may be introduced directly into the potassium aluminosilicate solution prior to the introduction of the substrate.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A method of manufacturing a decorative article, said method comprising the steps of:

(a) producing a chemically pure, over-saturated solution of potassium aluminosilicate;
(b) coating a substrate to be decorated with flock;
(c) introducing the substrate into the solution;
(d) removing the substrate from the solution after crystals have grown on the substrate;
(e) drying the crystals; and
(f) coating the crystals with a transparent, brilliant liquid plastic.

2. The method recited in claim 1 and comprising the further step of dyeing the plastic.

3. The method recited in claim 2 wherein the dye is added to the liquid plastic prior to its being coated on the crystals.

4. The method recited in claim 2 wherein the dye is coated on the plastic after it has dried.

5. The method recited in claim 1 and comprising the further step of introducing dye into the solution prior to the introduction of the substrate.

6. The method recited in claim 1 wherein the substrate is introduced into the solution when the solution is at approximately 37 degrees Celsius.

7. The method recited in claim 1 wherein the liquid plastic is a methacrylate resin.

8. A decorative article manufactured by the method recited in claim 1.

* * * * *